US011359325B2

(12) United States Patent
White et al.

(10) Patent No.: US 11,359,325 B2
(45) Date of Patent: Jun. 14, 2022

(54) METHOD AND APPARATUS FOR CLEANING LAUNDRY

(71) Applicant: Electrolux Appliances Aktiebolag, Stockholm (SE)

(72) Inventors: Allison White, Charlotte, NC (US); Yihong Li, Charlotte, NC (US); Oscar Madalena, Charlotte, NC (US)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 204 days.

(21) Appl. No.: 16/131,921

(22) Filed: Sep. 14, 2018

(65) Prior Publication Data

US 2020/0087835 A1 Mar. 19, 2020

(51) Int. Cl.

| | |
|---|---|
| ***D06F 39/02*** | (2006.01) |
| ***D06F 37/04*** | (2006.01) |
| ***D06F 39/08*** | (2006.01) |
| ***D06F 23/02*** | (2006.01) |
| ***D06F 21/02*** | (2006.01) |
| *D06F 21/04* | (2006.01) |
| *D06F 35/00* | (2006.01) |
| *D06F 37/30* | (2020.01) |
| *D06F 39/10* | (2006.01) |

(52) U.S. Cl.

CPC ..... *D06F 39/02* (2013.01); *D06F 21/02* (2013.01); *D06F 23/02* (2013.01); *D06F 37/04* (2013.01); *D06F 39/022* (2013.01); *D06F 39/08* (2013.01); *D06F 39/088* (2013.01); *D06F 21/04* (2013.01); *D06F 35/006* (2013.01); *D06F 37/304* (2013.01); *D06F 39/10* (2013.01)

(58) Field of Classification Search

CPC ..... D06F 21/02; D06F 23/02; D06F 39/02; D06F 39/022; D06F 39/08; D06F 39/088

See application file for complete search history.

(56) References Cited

U.S. PATENT DOCUMENTS

| | | | |
|---|---|---|---|
| 2,821,848 | A | 2/1958 | Becker |
| 2,933,912 | A | 4/1960 | Billings |
| 4,882,917 | A | 11/1989 | Mizusawa et al. |

(Continued)

FOREIGN PATENT DOCUMENTS

| | | | |
|---|---|---|---|
| BR | 202014023113 | Y1 | 12/2019 |
| DE | 19537671 | A1 | 4/1997 |

(Continued)

OTHER PUBLICATIONS

International Search Report and Written Opinion issued in International Application No. POT/EP2020/071064, dated Nov. 9, 2020, 14 pages.

(Continued)

*Primary Examiner* — Joseph L. Perrin
(74) *Attorney, Agent, or Firm* — RatnerPrestia

(57) ABSTRACT

A laundry washing machine having a casing, a washing tub located within the casing, a drum mounted within the washing tub and configured to rotate relative to the casing, a door attached to the casing and being openable to provide access to the drum, a receptacle configured to receive a unit dose package comprising a water soluble pouch containing a dose of cleaning product, a tub supply pipe fluidly connecting the receptacle to washing tub, and means for mechanically breaking the unit dose package.

17 Claims, 7 Drawing Sheets

(56) References Cited

U.S. PATENT DOCUMENTS

| | | | | |
|---|---|---|---|---|
| 5,548,978 | A | 8/1996 | Bongini et al. | |
| 5,884,506 | A | 3/1999 | Blauert et al. | |
| 7,036,177 | B2 | 5/2006 | Aouad et al. | |
| 7,181,934 | B2 | 2/2007 | Hsu et al. | |
| 8,931,311 | B2 | 1/2015 | Leibman et al. | |
| 9,271,627 | B2 | 3/2016 | Alexander et al. | |
| 9,574,297 | B2 | 2/2017 | Berndsen et al. | |
| 9,637,857 | B2 | 5/2017 | Del Pos et al. | |
| 9,663,893 | B2 | 5/2017 | Malheiros | |
| 9,850,618 | B2 | 12/2017 | Burger et al. | |
| 9,903,063 | B2 | 2/2018 | Carpenter | |
| 9,970,148 | B2 | 5/2018 | Alexander et al. | |
| 9,976,246 | B2 | 5/2018 | Malheiros | |
| 10,480,113 | B2 | 11/2019 | Favaro et al. | |
| 10,519,590 | B2 | 12/2019 | Malheiros | |
| 10,731,284 | B2 | 8/2020 | Alexander et al. | |
| 10,815,607 | B2 | 10/2020 | Costa et al. | |
| 2004/0088796 | A1 | 5/2004 | Neergaard et al. | |
| 2004/0200245 | A1 | 10/2004 | Cheo et al. | |
| 2005/0102767 | A1* | 5/2005 | Aouad | D06F 39/024 8/159 |
| 2005/0166645 | A1 | 8/2005 | Favret et al. | |
| 2005/0229652 | A1 | 10/2005 | Kim et al. | |
| 2005/0241072 | A1 | 11/2005 | Kim et al. | |
| 2005/0274156 | A1 | 12/2005 | Yang | |
| 2007/0130700 | A1 | 6/2007 | Cho et al. | |
| 2007/0163307 | A1 | 7/2007 | Kramme et al. | |
| 2009/0119849 | A1 | 5/2009 | Hili et al. | |
| 2009/0293203 | A1 | 12/2009 | Hettinger et al. | |
| 2011/0247147 | A1 | 10/2011 | Amos et al. | |
| 2012/0060568 | A1 | 3/2012 | Buso et al. | |
| 2012/0067089 | A1 | 3/2012 | Buso et al. | |
| 2012/0272691 | A1 | 11/2012 | Leibman et al. | |
| 2014/0060121 | A1 | 3/2014 | Burger et al. | |
| 2014/0060581 | A1* | 3/2014 | Alexander | D06F 34/28 134/18 |
| 2014/0060594 | A1* | 3/2014 | Alexander | D06F 39/02 134/56 D |
| 2014/0157835 | A1 | 6/2014 | Del Pos et al. | |
| 2014/0165663 | A1 | 6/2014 | Celotto et al. | |
| 2015/0013075 | A1 | 1/2015 | Herrera et al. | |
| 2015/0059413 | A1 | 3/2015 | Yoo et al. | |
| 2015/0267340 | A1 | 9/2015 | Malheiros | |
| 2015/0345069 | A1 | 12/2015 | Leibman et al. | |
| 2016/0047077 | A1 | 2/2016 | Leibman et al. | |
| 2016/0237612 | A1 | 8/2016 | Ghosh et al. | |
| 2017/0073877 | A1 | 3/2017 | Hettinger et al. | |
| 2017/0297770 | A1 | 10/2017 | Snider et al. | |
| 2018/0073185 | A1 | 3/2018 | Burger et al. | |
| 2018/0135226 | A1 | 5/2018 | Alexander et al. | |
| 2018/0155864 | A1 | 6/2018 | Alexander et al. | |
| 2019/0017208 | A1 | 1/2019 | Marangoni et al. | |
| 2019/0136440 | A1 | 5/2019 | Clarke et al. | |
| 2020/0370229 | A1 | 11/2020 | Bensel et al. | |
| 2021/0025103 | A1 | 1/2021 | Li et al. | |

FOREIGN PATENT DOCUMENTS

| | | | |
|---|---|---|---|
| EP | 1126070 | A1 | 8/2001 |
| EP | 2025798 | A2 | 2/2009 |
| EP | 2239363 | A1 | 10/2010 |
| EP | 2241669 | A1 | 10/2010 |
| EP | 3037582 | A1 | 6/2016 |
| EP | 3184688 | A1 | 6/2017 |
| EP | 3257998 | A1 | 12/2017 |
| EP | 3293302 | A1 | 3/2018 |
| EP | 2540902 | B1 | 5/2020 |
| EP | 3660198 | A1 | 6/2020 |
| FR | 1209601 | A | 3/1960 |
| GB | 586424 | | 3/1947 |
| GB | 589374 | | 6/1947 |
| JP | 2016073330 | A | 5/2016 |
| WF | 2016102005 | A1 | 6/2016 |
| WO | 2005059229 | A1 | 6/2005 |
| WO | 2005061685 | A1 | 7/2005 |
| WO | 2007051988 | A1 | 5/2007 |
| WO | 2015197109 | A1 | 12/2015 |
| WO | 2016101994 | A1 | 6/2016 |

OTHER PUBLICATIONS

Non Final Office Action for U.S. Appl. No. 16/131,757, dated Apr. 1, 2020, 17 pages.

International Search and Written Opinion for International Application No. PCT/EP2019/072846, dated Oct. 22, 2019, 11 pages.

USPTO Non Final Office Action issued in U.S. Appl. No. 16/131,912, dated Aug. 19, 2020, 19 pages.

USPTO Non Final Office Action issued in U.S. Appl. No. 16/131,/57, dated Oct. 16, 2020, 20 pages.

USPTO Notice of Allowance issued in U.S. Appl. No. 16/131,912, dated Dec. 9, 2020, 17 pages.

USPTO Non Final Office Action Issued in U.S. Appl. No. 16/522,156, dated Feb. 10, 2021, 46 pages.

USPTO Notice of Allowance issued in U.S. Appl. No. 16/131,912, dated Feb. 22, 2021, 14 pages.

International Search Report and Written Opinion for International Application No. PCT/EP2014/079129, dated Mar. 23, 2015, 11 pages.

International Search Report and Written Opinion for International Application No. PCT/EP2014/079176, dated Mar. 9, 2015, 9 pages.

International Preliminary Report on Patentability for International Application No. PCT/EP2014/079176, dated June 27, 2017, 7 pages.

International Search Report and Written Opinion for International Application No. PCT/IB2019/000746, dated Jun. 25, 2020, 18 pages.

USPTO Final Office Action issued in U.S. Appl. No. 16/131,757, dated Aug. 6, 2020, 15 pages.

USPTO Non Final Office Action issued in U.S. Appl. No. 16/131,757, dated Apr. 1, 2020, 17, pages.

International Search Report and Written Opinion for International Application No. PCT/EP2020/068875, dated Sep. 22, 2020, 11 pages.

International Search Report and Written Opinion for International Application No. PCT/EP2017/072466, dated Nov. 10, 2017—11 pages.

USPTO Notice of Allowance issued in U.S. Appl. No. 15/537,701, dated May 19, 2020, 9 pages.

USPTO Non Final Office Action issued in U.S. Appl. No. 16/131,935, dated Jan. 25, 2021, 14 pages.

USPTO Notice of Allowance issued in U.S. Appl. No. 16/332,116, dated Jan. 25, 2021, 8 pages.

USPTO Final Office Action issued in U.S. Appl. No. 16/131,935, dated Mar. 18, 2021, 21 pages.

USPTO Notice of Allowance issued in U.S. Appl. No. 16/131,757, dated Mar. 17, 2021, 30 pages.

USPTO Notice of Allowance issued in U.S. Appl. No. 16/332,116, dated Mar. 19, 2021, 23 pages.

USPTO Notice of Allowance issued in U.S. Appl. No. 16/522,156, dated Jun. 29, 2021, 10 pages.

USPTO Notice of Allowance issued in U.S. Appl. No. 16/131,935, dated Jun. 24, 2021, 12 pages.

Brazilian Written Opinion issued in Brazilian Application No. 112019003786-1, dated Jun. 23, 2021, 4 pages.

USPTO Non-Final Office Action for U.S. Appl. No. 17/128,947, dated Mar. 2, 2022, 9 pages.

Non Final Office Action for U.S. Appl. No. 17/541,941, dated Mar. 14, 2022, 11 pages.

* cited by examiner

METHOD AND APPARATUS FOR CLEANING LAUNDRY

TECHNICAL FIELD

The present invention concerns the field of laundry washing machines and fabric cleaning techniques, and particularly to machines and techniques using unit dose packages for detergent or other compositions.

BACKGROUND

The use of automated laundry washing machines is widespread. Such machines include both relatively simple laundry washing machines that can only wash and rinse laundry, and more complex laundry washing machines that can also dry laundry. The term "laundry washing machine" is used herein to refer to both types of laundry washing machine, and other laundry washing machines as may be known or later made available.

Laundry washing machines typically use a liquid solution to help remove soil from fabrics. The liquid solution usually is water-based, and may comprise water alone, or water mixed with additives (e.g., detergent, fabric softener, bleach, etc.). The cleaning solution may be provided at a variety of different temperatures.

A laundry washing machine typically includes a tub configured to receive and hold the cleaning solution and a drum rotatably mounted inside the tub to receive and hold fabric laundry products, such as clothing, bed sheets and other linens, curtains, and the like. The drum is perforated or otherwise configured to allow cleaning solution to pass between the tub and the drum. In "front-loading" washing machines, the drum rotates on a horizontal or nearly horizontal axis, and the cleaning solution is provided in the lower end of the tub, and as the drum rotates, the laundry is repeatedly raised and lowered into and out of the cleaning solution. In "top-loading" washing machines, the drum rotates on a vertical or nearly vertical axis, and the cleaning solution is provided, during the wash phase, at a level at which the laundry is immersed within the solution. The drum may be reciprocated back and forth to agitate the laundry and cleaning solution, or the drum may remain still while a separate agitator located inside the drum moves to perform the agitation.

The laundry washing machine may have a number of operation programs, which may be selected by the user or selected automatically based on detected conditions (e.g., load weight). In a typical wash phase, the laundry washing machine may determine the amount of wash water and rinse water according to a user's selection of a particular washing program, and then proceed to supply the appropriate amount of cleaning solution to the tub, operate the drum, and otherwise control the laundry washing machine components to execute the selected washing program.

Laundry washing machine additives may be provided in various forms, such as loose powder, liquid and gel. It is also known to provide additives in the form of a unit dose package (also known as a "UDP" or "pod"). The UDP typically comprises a pre-measured amount of treating agent, such as detergent, incorporated into a water-soluble pouch. The detergent may be, for example powder, liquid, paste, waxy or gel compositions, and the pouch typically comprises a water-soluble film. In some cases, the pouch may have multiple compartments containing different compositions. Suitable pouch materials can vary, but they typically comprise polymeric materials, copolymers, or mixtures of materials.

UDPs can be inserted directly into the laundry washing machine drum with the laundry load. However, the Applicants have found that UDPs provided in this way can suffer from various drawbacks.

One drawback is that the UDP might be dissolved only partially. For example, the UDP can become trapped within the laundry in a way that it is only partially-dissolved, which can lead to incomplete or inefficient cleaning and the formation of spots or stains on the laundry. The UDP also can become trapped in or on the bellows seal that surrounds the drum door, again leading to incomplete or inefficient cleaning. The Applicants have also found that pieces of undissolved UDP pouches often remain in the laundry or in the bellows.

A further drawback that the Applicants have identified is that the UDP can be loaded into the drum and dissolved to release the active ingredients before the washing cycle effectively begins. For example, a UDP may be loaded into the drum and begin dissolving in water present within the drum or in the clothing being cleaned. Then, if the washing cycle starts with a draining phase, which is typically performed for safety and/or hygienic reasons at the very beginning of the cycle, some of all of the active ingredients of the UDP may be flushed away during the initial draining phase.

Another drawback can occur if the washing cycle begins after a delay following insertion of the UDP. In such cases, the UDP may break down or its pouch may dissolve before the washing cycle begins, resulting on undesired spots or stains on the laundry due to contact of the highly concentrated detergent emitted from the UDP with the load of laundry. When this happens, the detergent also may fall to the bottom of the drum and be washed away during an initial draining cycle.

Still another drawback the Applicants have identified is that the effective time of breakage of the UDP and the release of detergent cannot be accurately predicted. Thus, the cleaning cycle cannot be optimized to provide the desired duration of contact between the detergent and the laundry.

The Applicants have developed alternative laundry washing machines that address these drawbacks. For example, the Applicants have provided a laundry washing machine that is configured to receive a UDP in a multipurpose additive dispenser compartment (i.e., within a dispenser drawer with compartments that receives detergent and other additives) having adjacent water inlets that are configured to shape the incoming liquid as a jet that can wet and pierce the UDP's water-soluble outer pouch. In this device, the UDP may be conveniently loaded into a compartment in a dispenser that can alternatively receive loose powdered detergent for the main wash phase, and the water jets break open the UDP while it is still in the drawer compartment. This provides more predictable dissolution of the detergent and the opportunity for improved cleaning. While such configurations have been successful and effective, the Applicants have determined that they have possible shortcomings. For example, the water jets that are supposed to break open the UDP pouch may be located in a fluid line having an air break that prevents reverse flow and siphoning, and this air break can limit the amount of hydraulic pressure available to create an effective water jet. In other cases, no air break may be in the water line, but the water pressure provided at the installation location may be insufficient to provide a water jet that can reliably break open different UDPs.

As another example, the Applicants have provided a system in which the UDP can be flushed from a multipurpose additive drawer to a sump located below the tub, where the UDP's contents mix with the water to provide a more dilute and uniform cleaning solution before being deposited on the laundry. This does not rely on the UDP being actively broken apart be water jets in the drawer, but instead relies on conventional dissolution of the UDP's water-soluble outer membrane. However, the Applicants have determined that relying on such dissolution can have shortcomings. For example, different UDP compositions may take different amounts of time to passively dissolve, and the overall time of the wash cycle may need to be increased to accommodate such passive dissolution to ensure complete mixing of the detergent.

As a result of the Applicant's study of its earlier works, the Applicant has determined that there is a need to provide alternative configurations for laundry washing machine UDP loading and processing systems.

This description of the background is provided to assist with an understanding of the following explanations of exemplary embodiments, and is not an admission that any or all of this background information is necessarily prior art.

SUMMARY

In one exemplary aspect, there is provided a laundry washing machine having: a casing, a washing tub located within the casing, a drum mounted within the washing tub and configured to rotate relative to the casing, a door attached to the casing and being openable to provide access to the drum, a receptacle configured to receive a unit dose package comprising a water soluble pouch containing a dose of cleaning product, a tub supply pipe fluidly connecting the receptacle to the washing tub, and means for mechanically breaking the unit dose package.

The means for mechanically breaking the unit dose package may be located in the receptacle. Such a means may include one or more blades and/or pins.

The means for mechanically breaking the unit dose package may be located in the tub supply pipe. Such a means may include one or more blades and/or pins.

The means for mechanically breaking the unit dose package may be located in a space between the washing tub and the drum, and may include one or more protrusions configured to strike the unit dose package upon rotation of the drum relative to the washing tub.

The means for mechanically breaking the unit dose package may include a mixer located in a sump at a bottom end of the washing tub.

The means for mechanically breaking the unit dose package may include a pump impeller.

In another exemplary aspect, there is provided a a laundry washing machine having: a casing, a washing tub located within the casing, a drum mounted within the washing tub and configured to rotate relative to the casing, a door attached to the casing and being openable to provide access to the drum, a receptacle configured to receive a unit dose package comprising a water soluble pouch containing a dose of cleaning product, one or more protrusions configured to mechanically break the unit dose package in the receptacle, and a tub supply pipe fluidly connecting the receptacle to the washing tub.

The one or more protrusions may include blades and/or pins.

The receptacle may be movably mounted to the casing between an open position and a closed position, and the one or more protrusions may be fixedly mounted to the casing at a location where the one or more protrusions project into the receptacle when the receptacle is in the closed position, such that movement of the receptacle from the open position to the closed position causes any unit dose package within the receptacle to contact the one or more protrusions.

The receptacle may be movably mounted to the casing between an open position and a closed position, at least a first protrusion may be fixedly mounted to the casing at a location where the first protrusion projects into the receptacle when the receptacle may be in the closed position, and at least a second protrusion may be fixedly mounted within the receptacle at a location where movement of the receptacle from the open position to the closed position causes any unit dose package within the receptacle to contact the first protrusion and the second protrusion.

The one or more protrusions may be movably mounted to the casing, and movable between a first position in which the one or more protrusions do not enter the receptacle and a second position in which the one or more protrusions enter the receptacle.

The receptacle may be a compartment in a multi-compartment additive loading and supply system.

In another aspect, there is provided a laundry washing machine having: a casing, a washing tub located within the casing, a drum mounted within the washing tub and configured to rotate relative to the casing, a door attached to the casing and being openable to provide access to the drum, a receptacle configured to receive a unit dose package comprising a water soluble pouch containing a dose of cleaning product, a tub supply pipe fluidly connecting the receptacle to the washing tub, and one or more blades or pins located in the tub supply pipe and configured to mechanically break the unit dose package while the unit dose package may be in the tub supply pipe.

The one or more blades or pins may include one or more rotating blades.

The one or more blades or pins may include one or more movable pins.

The laundry washing machine may include a retainer located in the tub supply pipe adjacent the one or more blades or pins and configured to prevent an unbroken unit dose package from exiting the tub supply pipe.

The receptacle may be a compartment in a multi-compartment additive loading and supply system.

The laundry washing machine may have an additive loading and supply system located upstream of the receptacle. A fluid passage from the additive loading and supply system to the receptacle may be dimensioned to allow the unit dose package to pass therethrough from the additive loading and supply system to the receptacle.

BRIEF DESCRIPTION OF THE DRAWINGS

Embodiments of the invention will now be described, strictly by way of example, with reference to the accompanying drawings, in which.

DESCRIPTION OF EXEMPLARY EMBODIMENTS

The exemplary embodiments described herein provide apparatus and methods for introducing UDPs into laundry washing machines. The exemplary embodiments are expected to provide advancements in one or more of efficiency, convenience, cleaning effectiveness, or other performance aspects for laundry washing machines, but the invention is not intended to be limited to any particular performance benchmark requirements.

Exemplary embodiments are described in the context of certain laundry washing machines, as described below. It will be understood that the laundry machines, may be regular washing machines or combined washing-drying machines. However, it will be understood that embodiments of the inventions are not limited to the particular structures or features of the described laundry washing machines, and that embodiments of the inventions may be conveniently applied to other types of laundry cleaning equipment. Such modifications will be understood by persons of ordinary skill in the art in view of the teachings provided herein.

Figure 1:
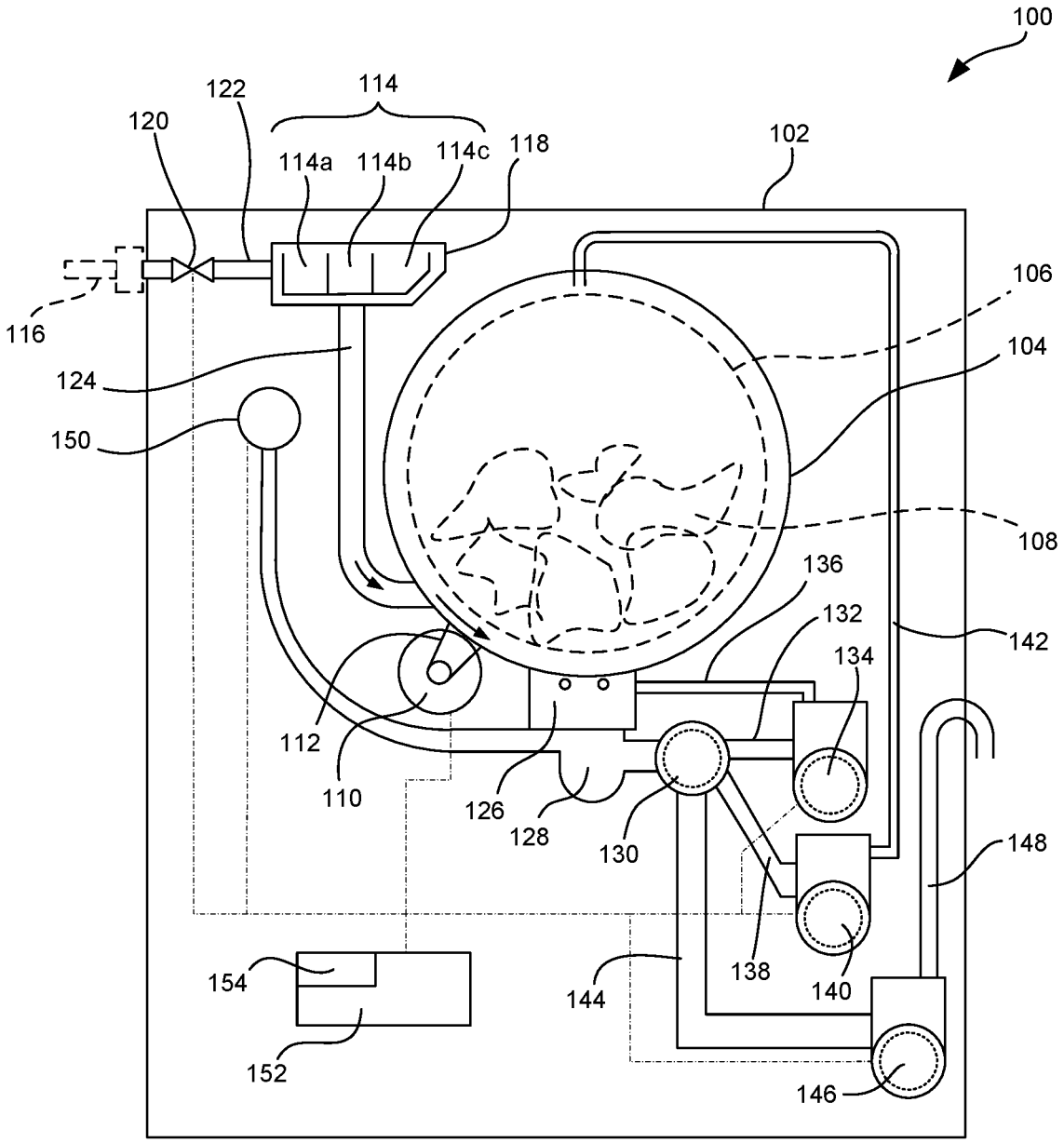
FIG. 1 is a schematic illustration of a laundry washing machine.
Figure 3:
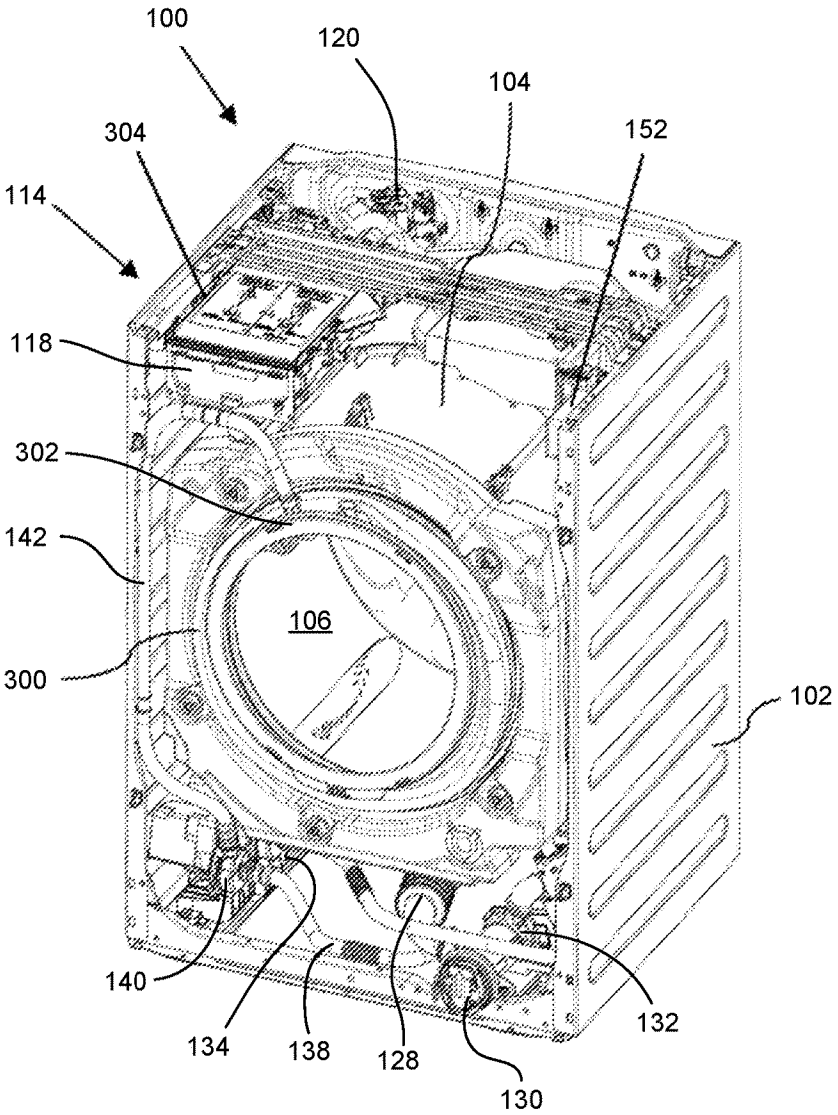
FIG. 3 is an isometric view of the laundry washing machine of FIG. 2, shown with the door, top and front panels removed to illustrate interior components.
Figure 2:
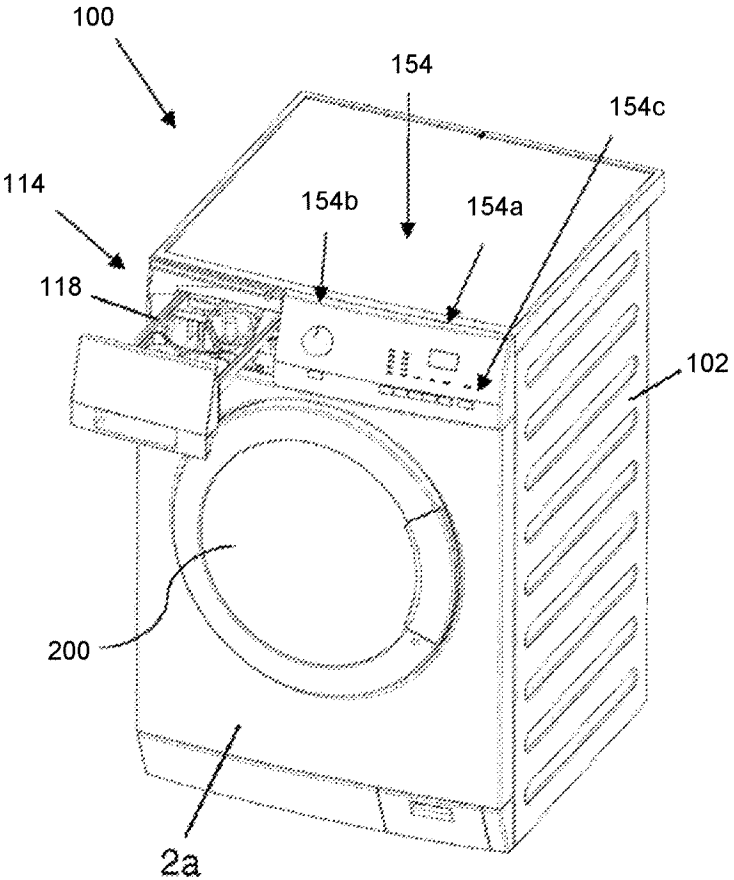
FIG. 2 is an isometric view of an exemplary laundry washing machine.
Figure 4:
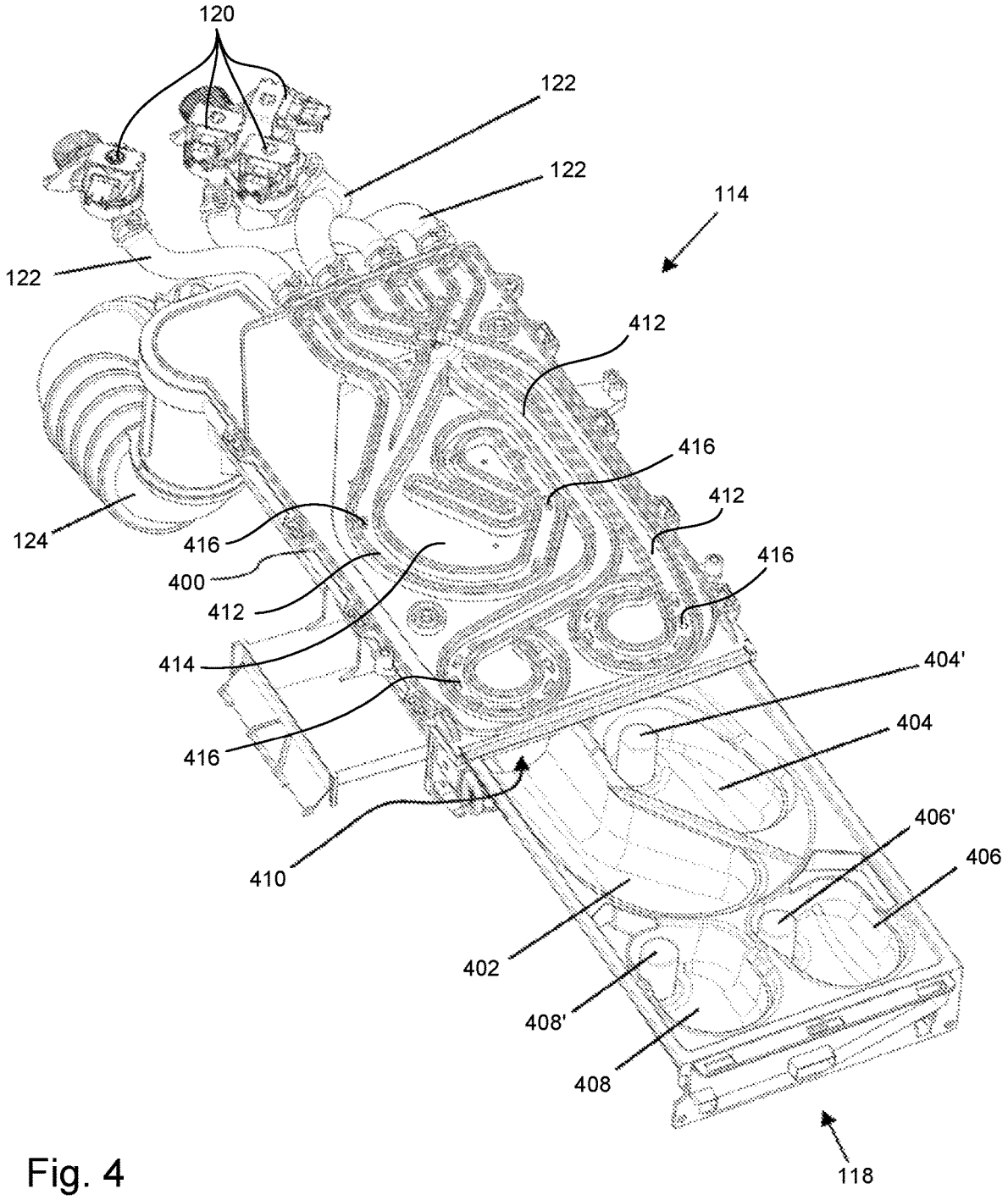
FIG. 4 is an isometric view of a treating agents dispenser of the laundry washing machine of FIG. 2, with a movable drawer in the opened position and a cover of the water distributor removed to view the fluid ducts therein.

FIG. 1 schematically illustrates a laundry washing machine 100 of the front loading variety. FIGS. 2 through 4 illustrate details of the embodiment of FIG. 1, as discussed in more detail below. The laundry washing machine 100 has an external housing or casing 102, in which a washing tub 104 is provided. The washing tub 104 contains a rotatable perforated drum 106 in which laundry 108 to be washed can be loaded. The washing tub 104 and the drum 106 both preferably have a generally cylindrical shape, and the drum 106 may include various internally-projecting or externally-projecting agitators or wash-enhancing structures, as known in the art. The casing 102 includes a door 200 (FIG. 2) that allows access to the drum 106 for loading and unloading laundry 108. A bellows 300 (FIG. 3) is provided around an open end of the tub 104 and drum 106 to form a water-tight seal with the casing 102 and the door 200, when the door 200 is closed, as known in the art. The washing tub 104 is preferably suspended in a floating manner inside the casing 102, such as by a number of springs and shock-absorbers (not illustrated). The drum 106 may be rotated by an electric motor 110 that is operatively connected to the drum 106 by a belt and pulley system 112 or other power transmission mechanisms (e.g., gears, chains, etc.). In some cases, the motor 110 can be directly connected to the drum 106 by a common shaft.

The laundry washing machine 100 includes an additive loading and supply system 114 that is connectable to a water supply system 116, such as household hot and cold water taps. The additive loading and supply system 114 and water supply system 116 preferably are in the upper part of the laundry washing machine 100, but other locations are possible. The additive loading and supply system 114 and water supply system 116 are structured to supply water and washing/rinsing products into the washing tub 104. Such cleaning products, as they are generically called, may include, for example, detergents, stain treatments, rinse additives, fabric softeners or fabric conditioners, waterproofing agents, fabric enhancers, rinse sanitization additives, chlorine-based additives, bleach, etc.

The additive loading and supply system 114 may include a dispenser tray with one or more compartments designed to be filled or loaded with washing and/or rinsing products. Such compartments may include, for example, a main wash detergent compartment 114*a*, a stain treatment detergent compartment 114*b*, a bleach compartment 114*c*, and a fabric softener compartment 114*d*. The main wash detergent compartment 114*a* may be configured to receive powdered detergent and/or detergent contained in a dissolvable UDP. A liquid detergent cup may be provided that is adapted to be received in the main wash detergent compartment for loading and dispensing liquid detergent for the main wash phase. It will be appreciated that there may be more or fewer compartments in the additive loading and supply system 114 as may be appropriate for the desired feature level of the washer and in the market in which the washer will be sold.

The dispenser tray containing the compartments may be integrated into a movable drawer 118 or a removable container. For example, the additive loading and supply system 114 may comprise a sliding drawer having separate compartments for detergent, bleach and softener. Such a slidable drawer 118 is shown in the opened position in FIG. 2, and in the closed position in FIG. 3. Alternatively, the additive loading and supply system 114 may comprise one or more compartments that are fixed in place within the casing 102, and the casing 102 may include an openable door in the front of the washer or an openable lid in the top of the washer through the case 102. The additive loading and supply system 114 may also be located behind the door in a front load washer or under the lid in a top load washer. In such embodiments, the user can load detergent and the like into the additive loading and supply system 114 through the opened door.

The additive loading and supply system 114 also may be connected to one or more controllable supply valves 120 by one or more main inlet pipes 122 (it will be understood that the term "pipe" includes rigid pipes, flexible hoses, open channels, and any other structure configured to convey liquid from one location to another). The supply valves 120 are selectively operable to provide hot and/or cold water to one or more of the compartments. Where multiple compartments are used, the supply valves 120 may be operated separately or simultaneously to dispense fluid into and through each compartment, either individually or in one or more groups, as known in the art, in order to dispense each washing/rinsing product into the washing tub 104 at the appropriate time in the wash cycle. As the water provided by the water supply system 116 passes through the compartments, it combines with the contents of the compartments, thus forming a liquid cleaning solution.

The water supply system 116 is connected to the washing tub 104 by one or more tub supply pipes 124. For example, the tub supply pipe 124 may comprise a passage that terminates at a lateral side or lower potion of the tub 104, as shown in the example of FIG. 1. Alternatively the tub supply pipe 124 may connect to the bellows 300 or seal that connects the opening of the tub 104 to the casing 102. The tub supply pipe 124 also may connect to the washing tub 104 by way of the drum 106—e.g., by being connected to a bellows that feeds directly into the drum 106, and thus also fluidly communicates with the washing tub 104 via holes in the drum 106. As another alternative, the supply pipe 124 may connect to a reservoir, where the incoming liquid solution accumulates and may be heated or agitated before being pumped via a separate pump to the tub 104. In any case, the liquid solution may enter the tub 104 directly (e.g., enter through an outer wall of the tub 104), or indirectly (e.g., enter the tub 104 by way of the drum 106 or a reservoir). Other alternatives and variations will be apparent to persons of ordinary skill in the art in view of the present disclosure.

The composition of the liquid solution passing through the tub supply pipe 124 preferably can selectively contain one of the products contained in the compartments of the drawer 118, or such liquid solution can be clean water (i.e., water without added products), depending on the phase of the washing program and user preferences. For example, in the initial phases of the main washing phase of a wash cycle, a liquid detergent solution may be conveyed from the main wash detergent compartment 114*a* into the tub 104 by the incoming water, while in other phases, such as during a rinsing phase, only water is conveyed into the tub 104.

In an optional aspect of the present invention, a sump 126 may be provided at the bottom of the tub 104, to provide, among other things, a reservoir in which water and one or more products from the drawer compartments can be thoroughly dissolved, mixed and evenly dispersed (homogenized) in the water prior to being deposited on the laundry 108 in the drum 106. The wash liquid in the sump may also be heated to a sufficient temperature to fully activate the detergent prior to being deposited on the laundry 108 in the drum 106 for enhanced cleaning effectiveness. The volume of the sump 126 may be selected to completely hold an initial charge of the incoming wash liquid solution. The initial charge of water maybe of a quantity sufficient fill the drum 106 to a level at which wash solution is below the drum 106 and does not wet the laundry on the drum.

In the shown embodiment, the sump 126 is fluidly connected to a main outlet pipe 128, which leads to a filter 130. The filter 130 (which is optional), is provided to filter debris that might be harmful to the downstream pump or pumps from the liquid solution. Any suitable filter type may be used (e.g., paper, plastic or metal mesh, etc.). The outlet of the filter 130 may be connected to a first pipe 132 that leads to the inlet of a recirculation pump 134. The outlet of the recirculation pump 134 is connected to a recirculation pump outlet pipe 136 that leads back to the sump 126. Upon activation, the recirculation pump 134 draws liquid solution out of the sump 126 and then pumps it back into the sump 126, to thereby fully dissolve the detergent, and mix and homogenize the wash solution. A heater may also be provided in the sump (or other suitable location in the recirculation path) to assist with the process of activating the detergent or other active ingredients in the liquid solution.

The outlet of the filter 130 is also connected to a second pipe 138, which leads to the inlet of a distribution pump 140. The outlet of the distribution pump 140 is connected a distribution pump outlet pipe 142 that leads to the tub 104. Once the detergent has been substantially fully dissolved, homogenized and activated in the wash liquid in the sump, the distribution pump 140 is activated to convey the liquid solution from the sump 126 to an upper region of the drum 106, where the liquid solution is applied to the laundry 108 as the drum is rotated to wet the laundry with the wash liquid. The distribution pump outlet pipe 142 preferably is positioned to effectively distribute the liquid solution throughout the laundry 108. For example, it may lead to a tub inlet 302 located on an upper portion the bellows seal 300 surrounding the drum closure door 200, or the like, and there may be a spray nozzle on the outlet to spray the wash liquid on the laundry. An additional charge of water is supplied to the drum to raise the level of the wash liquid into the lower portion of the drum, such that as the drum is rotated the laundry is lifted by vanes in the drum out of the wash liquid and dropped back into the wash liquid.

The outlet of the filter 130 is also connected to a water draining system that is configured to drain the liquid solution, e.g., dirty water or water mixed with cleaning products and dirt, from the tub 104 and drum 106. For example, the water draining system may include a third pipe 144 that connects the outlet of the filter 130 to the inlet of a draining pump 146. The outlet of the draining pump 146 is fluidly connected to a main outlet pipe 148. Upon activation, the draining pump 146 conveys liquid solution from the sump 126 to the main outlet pipe 148. The main outlet pipe 148 is configured to be fluidly connected to a household draining pipe system (not illustrated).

The first pipe 132, second pipe 138 and third pipe 144 are shown as being fluidly separate from one another, but it will be appreciated that they may be fluidly connected as branches of a common fluid passage. It will also be appreciated that each of the pumps 134, 140, 146 may have its own separate filter or one or more may not have a filter. Also, the main outlet pipe 128 may be directly connected to the draining pump 144, rather than passing through the filter.

In other embodiments, one or both of the recirculation pump 134 and the distribution pump 140 (as well as the associated fluid paths) may be omitted. For example, both pump 134, 140 may be omitted, and the tub supply pipe 124 may lead directly to a drum inlet 302 located at the top of the bellows door seal 300. As another example, the recirculation pump 134 may be omitted, but the distribution pump 140 may remain to pump the detergent from the sump 126 to the top of the drum 106. Other alternatives and variations will be apparent to persons of ordinary skill in the art in view of the present disclosure.

The laundry washing machine 100 may be advantageously provided with one or more liquid level sensors 150 (schematically illustrated in FIG. 1) configured to sense or detect the liquid level inside the tub 104 as is well understood in the art. The level sensor 150 may comprise, for example, a pressure sensor that is acted upon by the liquid in the tub 104 to provide a sensor signal indicative of the liquid level of the wash water and/or the foam level contained in the tub 104. In some cases, the pressure sensor may be fluidly connected with a draining sump of the water draining system. The level sensor 150 also may comprise a mechanical, electro-mechanical, electrical, or optical fluid level measuring system, etc. Such devices are known in the art (e.g., floats, capacitance sensors, etc.) and need not be described in detail herein.

The laundry washing machine 100 also includes a control unit 152. The control unit 152 includes hardware and software configured to operate the laundry washing machine. In one example, the control unit 152 includes one or more processors that are programmed to execute machine-readable code stored on one or more memory devices. A typical processor may be a central processing unit (CPU), a microprocessor, an application-specific integrated circuit (ASIC), and so on. Memory devices may be provided as random access memory (RAM) for temporary data storage, read only memory (ROM) for permanent data storage, firmware, flash memory, external and internal hard-disk drives, and the like. The processor communicates with the memory device via a communication bus or the like to read and execute computer-readable instructions and code stored in a non-transient manner in the memory devices. The incorporation of control units into laundry washing machines is well-known in the art and the details of the control unit 152 need not be explained in more detail herein.

The control unit 152 is operatively connected to the various parts of the laundry washing machine 100 in order to control its operation. The control unit 152 preferably is operatively connected to: the electric motor 110 so that the drum speed may be controlled; the controlled supply valves 120 so that the water supplied to the drawer 118 is controlled; and to the pumps 134, 140, 146 to control their respective operations. The control unit also may be connected to the level sensor 150 to determine a level of water and/or foam inside the tub 104, a load weight measuring system, one or more water temperature sensors, lockout switches (e.g., a switch that prevents operation if the loading/unloading door 200 is opened), and so on. The control unit 152 also may be configured to perform unbalanced laundry checks to verify whether the laundry 108 loaded in the drum 106 is balanced or not, and to perform various conventional operations.

The operative connections between the control unit 152 and the remaining parts (shown schematically by dashed lines) may be by electrical wires, wireless communication, and the like. Suitable control devices (e.g., solenoids to operate valves, motor controllers, etc.) are provided to allow the control unit 152 to operate the various components. Conventional fuses, power converters, and other ancillary features also may be included as necessary or desired.

The control unit 152 is also operatively connected to a user interface 154 that is accessible to the user. The user interface 154 is configured to allow the user to select and set the washing parameters, for example by selecting a desired washing program. The user interface 154 also may be configured to allow the user to input other operating parameters, such as the washing temperature, the spinning speed, the load in terms of weight of the laundry to be washed, the type of fabric of the load, etc.

The user interface 154 may comprise any suitable arrangement of input and output mechanisms. For example, input may be provided by one or more dials, switches, buttons, touchscreens, or the like, and output may be provided by one or more position markers, textual or graphic images, illuminable lights or displays, touchscreens, and so on. In one example, the user interface includes a display 154*a*, power button, a rotatable operation program selection dial 154*b* that selects among pre-set operation programs (e.g., sanitary cycle, light load, heavy load, etc.), and a number of operation program adjustment buttons that can be operated to modify aspects of the pre-set operation programs (e.g., temperature adjustment, time adjustment, spin speed adjustment, etc.). One input may comprise a dedicated UDP or Pod cycle input 154*c* button or selector.

The control unit 152 is configured to operate the various parts of the laundry washing machine 100 to effectuate the pre-set operation programs, and to make adjustments to these operation programs based on user input. The control unit 152 also may use sensor feedback to modify the cycles and variables for each pre-set operation program. For example, the control unit 152 may change the volume of water used during a particular load cycle based on detecting a load weight above a certain value. As another example, the control unit 152 may reduce the spin speed of a particular spin cycle if a balance indicator (e.g., an accelerometer or the like) indicates excessive vibration. Other alternatives and variations will be apparent to persons of ordinary skill in the art in view of the present disclosure.

FIG. 4 illustrates features of the additive loading and supply system (or additive supply system) 114 and related components, including the valves 120, main inlet pipes 122, drawer 118, and tub supply pipe 124. The additive loading and supply system 114 includes the drawer 118, which is slidingly received within a drawer housing 400. The exemplary drawer 118 includes a main wash compartment 402, and may include additional compartments, such as a second compartment 404, a third compartment 406, and a fourth compartment 408, as previously described.

The first or main wash compartment 402 is configured to receive powdered detergent, liquid detergent with the insertion of an inset cup, or detergent provided in a UDP form for the main wash phase of a wash cycle. In particular, the main wash compartment 402 is sized to receive UDPs having one or more shapes and sizes. The main wash compartment 402 has an open rear end to allow powder detergent or the UDP to move out of the main wash compartment 402, through a funnel, into the supply pipe 124 and to the tub. The main wash compartment may be in the form of a trough (e.g. gutter) formed in the bottom internal wall of the drawer housing 400 that slopes downward to the funnel/tub supply pipe 124 located adjacent the rear end of the bottom wall.

The additional compartments 404, 406, 408 are configured to receive liquid additives (e.g., liquid detergent, fabric softener, fabric conditioners, waterproofing agents, fabric enhancers, rinse sanitization additives, chlorine-based additives, bleach, etc.). Each additional compartment has a respective siphon tube 404', 406', 408' that empties into the space between the bottom internal wall of the drawer housing and a lower external wall of the drawer housing. The external lower wall slopes downward toward a read end of the drawer housing and the lower outer wall, to allow liquid additives to move out of the drawer housing, through the funnel and the supply pipe 124, and into the tub. The funnel for the liquid additives may be the same as the one provided for the dry detergent, but separate funnels may be used if desired.

Dry detergent, UDPs and liquid additives are moved from their respective compartments to the tub supply pipe 124 by activating the appropriate valves 120 to create water flows to move the additives. In the illustrated example, the valves 120 are fluidly connected to a plurality of fluid ducts 412 located in the upper wall 414 of the drawer housing 400. The ducts 412 include respective outlet ports 416 that direct incoming hot and/or cold water to one or more of the compartments. The outlet ports 416 may have any desired configurations and positions. The ducts 412 are shown for clarity in FIG. 3 as being open to the top, but in normal use they preferably are sealed from above by a cover 304 (FIG. 3) to prevent leakage.

Selective operation of the valves 120 can be implemented to direct fluid to the desired compartment at the desired time, as known in the art. Water directed to the main wash detergent compartment 402 causes the main wash detergent or UDP to move through the outlet 410 and into the tub supply pipe 124. To this end, the bottom wall of the main wash compartment 402 may be sloped downwards towards the outlet 410. Such slope may be selected such that powdered detergent or a UDP does not move through the outlet 410 until water is provided into the main wash compartment. In those cases in which a liquid detergent is desired to be added to the compartment, a removable cup having a siphon (not shown) may be provided to hold the liquid detergent and prevent it from flowing through the outlet 410. Water directed to the liquid additive compartments 404, 406, 410 (or to compartment 402 when a liquid cup is used) accumulates in those compartments until the liquid level is high enough to enter the respective siphon 404', 406', 408', resulting in ejection of the liquid through the siphon 404', 406', 408'.

As noted above, it is known from the Applicant's prior work to configure a compartment such as the main wash compartment 402 to have features for actively breaking open a UDP. For example, one or more of the outlets 416 may be configured to generate water jets that penetrate the UDP's outer pouch. It is also known from the Applicant's prior work that a UDP that is not actively broken open (either by a failure of the water jets or simply an absence of the water jets from the device) may progress to a sump 126 where it is opened by conventional dissolution of the water-soluble outer pouch. While those configurations and machine functionalities are both useful (and may be used with embodiments of the present invention), other alternatives are believed to be useful. The following embodiments described herein preferably are configured to provide active UDP mechanical breaking of the UDP by interaction between the UDP and a solid physical structure (as opposed to, or in addition to, hydraulic penetration via water jets as noted above).

Figure 5A:
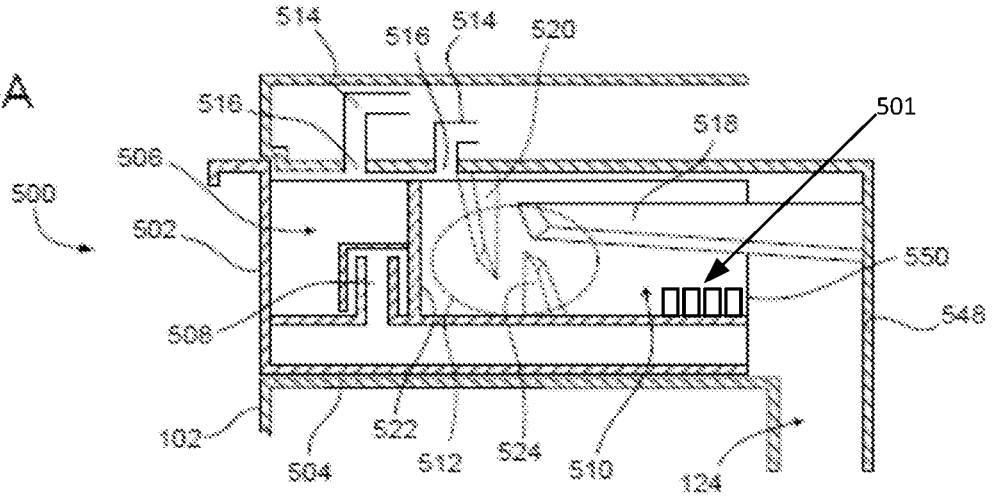
FIGS. 5A through 5C are schematic illustrations of three different embodiments of mechanical UDP breaking devices associated with additive loading and supply systems.

In some embodiments, a laundry washing machine may have a mechanical UDP breaking mechanism operatively associated with the additive loading and supply system 114. For example, FIG. 5A shows a laundry washing machine additive loading and supply system 500 comprising a drawer 502 that slidingly fits into a corresponding receptacle 504 in the machine housing 102. The drawer 502 may have multiple compartments to receive additives, such as a main wash compartment 506 configured with a siphon tube 508 for receiving liquid additives (bleach, detergent, etc.), and a second compartment 510 configured to receive a UDP 512, dry powder detergent, detergent gel, and so on. The second compartment 510 has an open end 550 that communicates with a tub supply pipe 124. One or more liquid passages 514 are connected to corresponding outlets 516 above the compartments to provide water or the like to mix with the contents of the compartments, such as described above.

In this embodiment, a mechanical UDP breaking mechanism is provided in the form of one or more sharp blades 518 (e.g., plates or sheets of plastic or metal material that have surfaces converging to form an edge, which may be straight, curved, serrated, etc.) located within the volume of the second chamber 510. The blades 518 are rigidly mounted to an interior wall of the drawer receptacle 504, and positioned such that the UDP 512 is forced into contact with the blades 518 as the drawer 502 is moved into the fully-closed position within the receptacle 504. The precise positions of the blades 518 are not necessarily critical, and it will be appreciated that the positions merely need to be selected such that a typical or expected size UDP 512 will be unable to occupy the internal volume of the second compartment 510 without intersecting one or more of the blades 518.

FIG. 5A shows the blades 518 on blades that extend from the back wall 548 of the receptacle 504. In other embodiments, the blades 518 may be located elsewhere, such as extending from a top wall of the receptacle, as shown by the blade 520 represented in broken lines. A combination of blades at different locations also may be used.

In use, a UDP 512 is loaded into the second compartment 510, and the drawer 502 is slid into the receptacle 504 until it is fully seated therein. As the drawer 502 and second compartment 510 slide, the UDP 512 eventually comes into contact with the blades 518 and becomes trapped between the blades 518 and the distal wall 522 of the second compartment 510. At this point, further movement of the drawer 502 towards the fully-seated position causes the distal wall 522 to press the UDP 512 against the blades 518, and such contact cuts and/or tears the UDP's pouch open to release the contents of the UDP 512. The contents can then be flushed down the tub supply pipe 124 by water provided through the corresponding outlet 516.

The blades 518 and distal wall 522 may be shaped to help with breaking the UDP 512. For example, as shown, the distal wall 522 may be vertical, and the blades 518 may include an angled component that leans towards the distal wall 522 to hold the UDP 512 down as the drawer 502 is advanced. The second compartment 510 also may include other structures that help to press the UDP 512 against the blades 518 or assist with breaking open the UDP 512. For example, the second compartment 510 may include a series of ribs 501 or slots (e.g. located at or near the open end 550 of the compartment 510) that extend towards and intermesh with the blades 518 as the drawer 502 is moved into the fully-closed position. Such ribs would push the UDP 512 further against the blades 518 to enhance the cutting and tearing action. Such ribs also could be formed as sharp blades. In another example, the second compartment 510 may include blades 524 and the blades 518 may be omitted from the receptacle 504 and replaced by a surface against which the second compartment's blades 524 press the UDP 512 to break it open. The blades 518, 520, 524 also may be replaced with pins or the like to pierce the UDP pouch. Other alternatives and variations will be apparent to persons of ordinary skill in the art in view of the present disclosure.

Figure 5B:
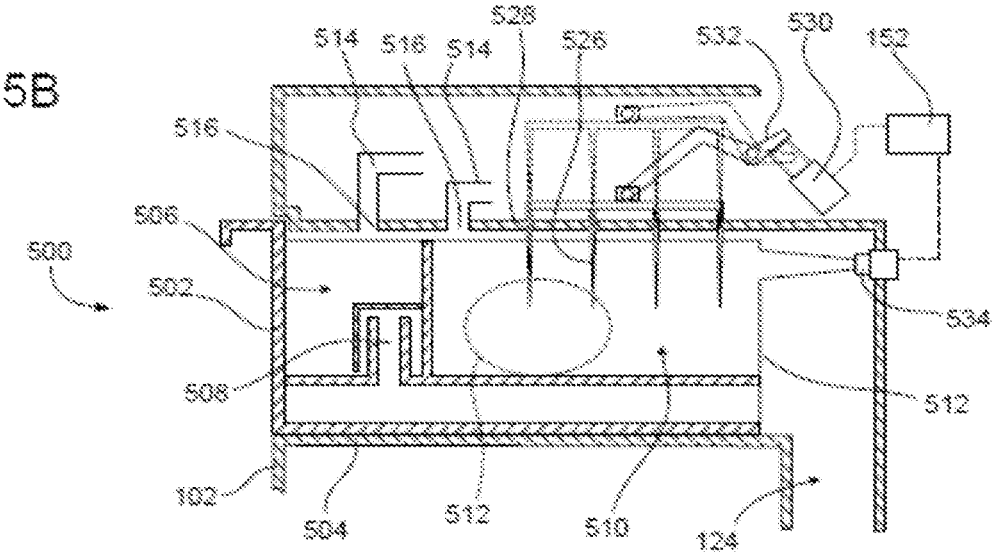

FIG. 5B shows another example of a UDP breaking mechanism that is operatively associated with the additive loading and supply system 500. The additive loading and supply system may comprise a drawer 502 that is slidable within a receptacle 504, and the additive loading and supply system 500 may have multiple compartments, such as first and second compartments 508, 510, to receive one more different kinds of additive. In this case, the second compartment 510 is configured to receive a UDP 512. The UDP breaking mechanism comprises one or more needles 526 that are mounted to the laundry washing machine in proximity to the second compartment 510, and movable between a first position (broken lines) in which the needles 526 are not positioned to break the UDP 512, and a second position (solid lines) in which the needles 526 are positioned within the volume of the second chamber 510 where they can break the UDP 512. The needles are shown as being sharp, but they may be blunt in other embodiments. The first position may be entirely outside the second chamber 510, but this is not strictly required.

The needles 526 may be movably mounted and operated using any suitable mechanism. In the illustrated example, the needles 526 are slidable through respective holes in an upper wall 528 of the receptacle 504. The needles 526 are operated by a solenoid 530 or a comparable motor (e.g., a rotating electric motor, a pneumatic or hydraulic piston, etc.). The solenoid 530 or motor may be operatively connected to move the needles 526 between the first and second positions using any suitable linkage. For example, the solenoid 530 may drive the needles 526 downward from the first position to the second position by way of an intermediate bell-crank linkage 532 or the like, and a return spring (not shown) may push the needles 526 back to the first position.

The needles 526 may be activated under the control of a control unit 152 to move to the second position at the appropriate time. For example, the control unit 152 may activate the solenoid 530 upon detecting that the drawer 502 is fully seated within the receptacle 504. Such detection may be by any suitable switch 534 or the like, such as a microswitch, an optical break switch, a magnetic (e.g., Hall-effect) switch, and so on. The needles 526 also may be manually operated by a user, such as by providing a lever or button to manually move the needles 526, or by connecting the needles 526 to a linkage that is driven by movement of the drawer 502 into the fully-closed position.

The embodiment of FIG. 5B may be modified in various ways while still maintaining the desirable UDP breaking function. For example, the drawer 502 and receptacle 504 configuration may be replaced with a fixed structure to receive the UDP 512 and a movable cover, such as the lid discussed below. The needles 526 also may be replaced by blades, or a combination of blades and needles or other structures for breaking apart the UDP pouch. Other alternatives and variations will be apparent to persons of ordinary skill in the art in view of the present disclosure.

Figure 5C:
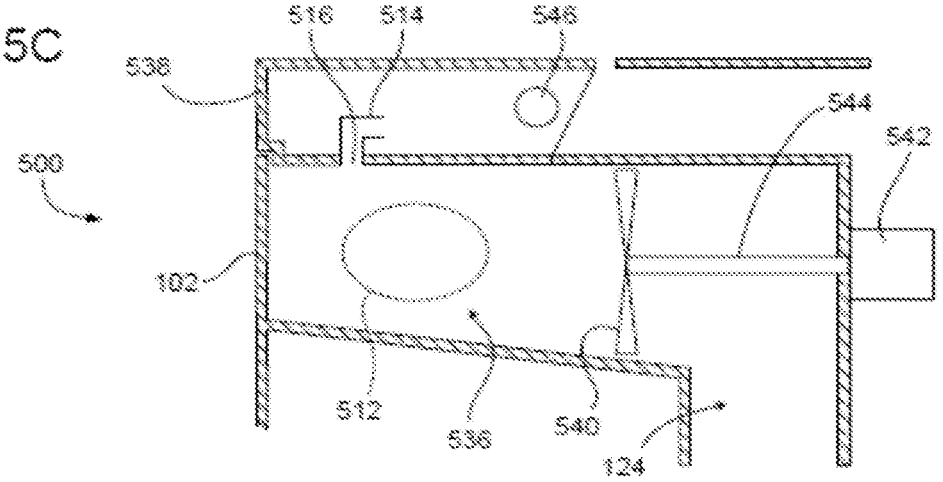

FIG. 5C shows another example of a UDP breaking mechanism that is operatively associated with an additive loading and supply system 500. In this case, the additive loading and supply system 500 comprises a fixed chamber 536 within the machine housing 102. A movable (e.g., pivotable or slidable) cover 538 is provided to selectively open and enclose the chamber 536. The cover 538 may include a liquid outlet 516, but this is not strictly necessary. The chamber 536 is sized to receive a UDP 512, and an open end of the chamber 536 connects to a tub supply pipe 124. The bottom wall of the chamber 536 (or the entire chamber 536) may be slanted to encourage the UDP 512 to move towards the tub supply pipe 124.

The UDP breaking mechanism comprises one or more movable blades 540 located within the chamber 536 or the tub supply pipe 124. The blades 540 may be operated by a rotary electric motor 542, a hydraulic pump, or any other suitable power source, and may be connected to the power source by any suitable linkage, such as a drive shaft 544. The blades 540 also may be manually operated, such as by a drive linkage between the cover's pivot 546 and the drive shaft 544. The blades 540 may have any suitable structure, such as spaced apart flat blades, a plate with sharpened openings forming blades, angled blades, counter-rotating blades, and so on.

In use, the blades 540 are rotated to cut the UDP pouch in one or more places, and preferably in several places, as the UDP passes from the chamber 536 and through the tub supply pipe 124. The blades 540 are shown at the back of the chamber 536, but they may be moved to other locations. For example, the blades 540 may be located within the chamber 536, or within any portion of the tubs supply pipe 124. The blades 540 also may be located at the bottom of the chamber 536, such that the UDP 512 falls directly on the blades 540 when it is dropped into the chamber 536 from above. Other alternatives and variations will be apparent to persons of ordinary skill in the art in view of the present disclosure.

Figure 6:
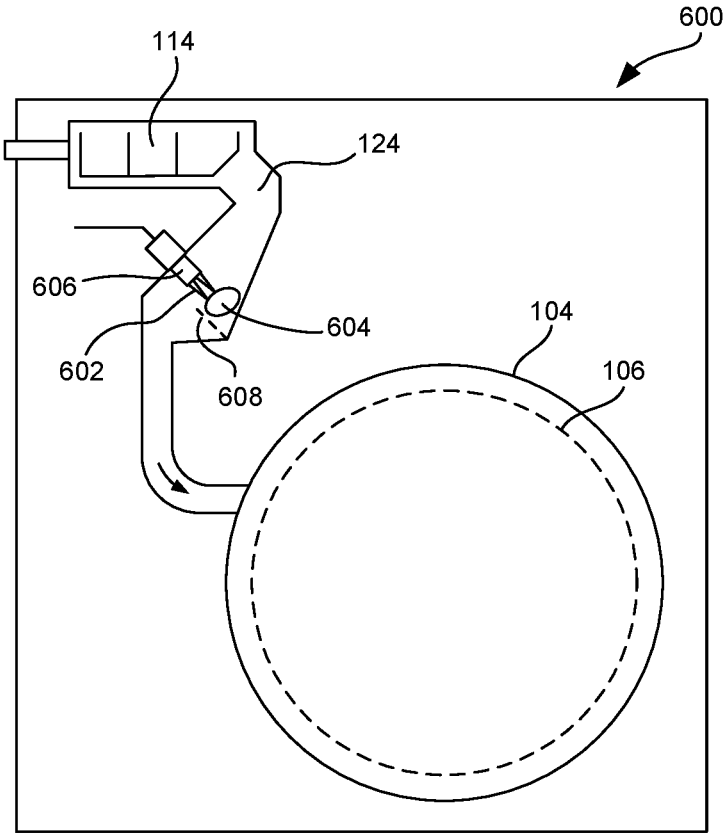
FIG. 6 is a schematic illustration of another embodiment of a laundry washing machine having a mechanical UDP breaking device.

Another example of a UDP breaking mechanism is shown in FIG. 6. In this case, the UDP breaking mechanism is in a tub supply pipe 124 between the additive loading and supply system 114 and the tub 104. The UDP breaking mechanism comprises one or more pins 602 that break the UDP 604 as it passes through the tub supply pipe 124. The pins 602 may be provided on a movable mount 606 or otherwise by movable between a disengaged retracted position and an engaged position to pierce the UDP 604. The movable mount 606 may be controlled by any suitable actuator (e.g., an electric solenoid, hydraulic ram or electric motor), and may have any suitable motion path (e.g., a slider or a rotating arm). FIG. 6 shows the UDP breaking mechanism in an enlarged portion of the tub supply pipe 124, but this is not required, and the tub supply pipe 124 may have a uniform cross section (or reducing cross section) at the location of the UDP breaking mechanism.

The UDP breaking mechanism also may include a retainer 608 that holds the UDP 604 at a proper location for engagement by the pins 602. The retainer 608 may comprise, for example, a perforated plate, a wire mesh, one or more rods or ribs that extend into or pass through the tub supply pipe 124, and so on. The retainer 608 also may comprise a restriction in the cross-sectional shape or size of the tub supply pipe 124. For example, the direction of the tub supply pipe 124 may transition abruptly, or the cross-sectional size might funnel down to a smaller dimension through which the UDP 604 is unable to pass until it is broken apart. The retainer 608 also may be movable by any suitable control mechanism. For example, the retainer 608 may comprise a flap of valve that slides, pivots, rotates, etc.

It will be appreciated that the pins 602 may be replaced by any solid physical structure that is moved into contact with the UDP 604 to mechanically break open the pouch. For example, the pins 602 may be replaced by blades to cut the UDP 604, or a blunt structure that crushes the UDP 604 or an abrasive surface that tears the UDP 604 open. The pins 602 or other mechanism may be configured to merely penetrate the pouch (e.g., leave a pattern of penetrations that facilitate dissolution by water), or it may be configured to physically tear apart the pouch (e.g., cleave the entire pouch into two halves).

It will also be appreciated that the UDP 604 may be moved into contact with the breaking mechanism, rather than the other way around. For example, the retainer 608 may be an articulated platform that moves up to move the UDP 604 into contact with the pins 602.

The portion of the tub supply pipe 124 located upstream of the UDP breaking mechanism is dimensioned and shaped to allow a UDP having a conventional shape and size to pass from the additive loading and supply system 114 to the UDP breaking mechanism. To this end, the upstream portion of the tub supply pipe 124 may have a cross-sectional area and cross-sectional shape selected to accommodate conventional UDP products. It will be understood by persons of ordinary skill in the art that various UDP products are provided having somewhat different shapes and sizes, but such products generally fall within a concise and well-understood range of dimensions. The remaining portions of the tub supply pipe 124—i.e., those portions downstream of the pins 602 may have any suitable size, and may not be sized to allow an unbroken UDP 512 to pass therethrough.

In use, the UDP 604 is loaded into the additive loading and supply system 114, and conveyed down the tub supply pipe 124 by a flow or water and/or gravity. When the UDP 604 reaches the pins 602, the pins 602 are activated to pierce the UDP 604. A sensor, such as an infrared break beam sensor, a contact switch, or the like, may be used to indicate when the control system should activate the pins 602. For example, the retainer 608 may contact a microswitch when it receives the UDP 604 to signal that the UDP 604 is in the proper position for breaking. Alternatively, the sensor may be omitted and the breaking mechanism may be activated after a predetermined amount of flushing water is added or after a certain amount of time after flushing begins, with the assumption being that the UDP will be properly positioned at that time. Once the UDP 604 is broken open, it (or its contents) continue down the tub supply pipe 124 to the tub 104.

Figure 7:
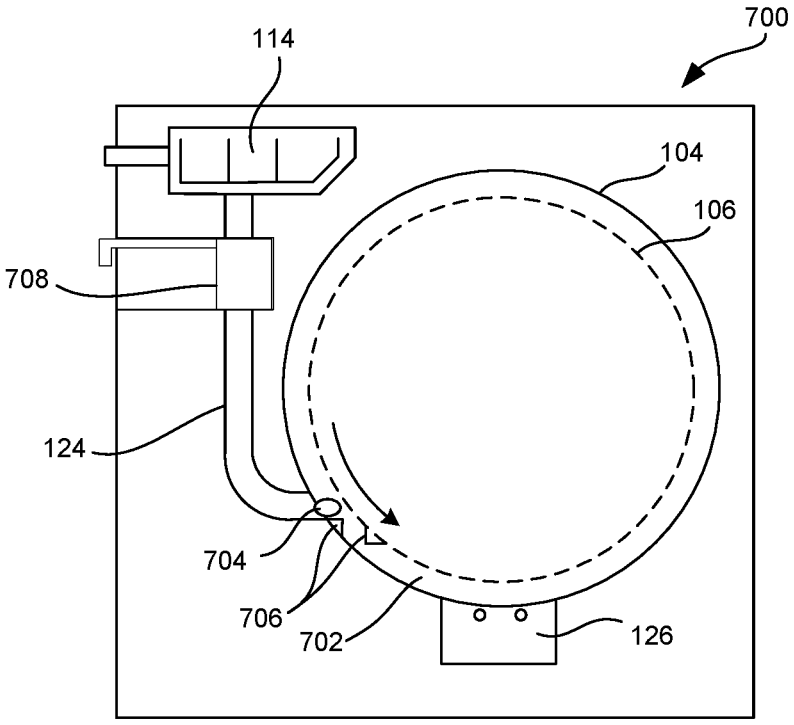
FIG. 7 is a schematic illustration of another embodiment of a laundry washing machine having a mechanical UDP breaking device.

FIG. 7 shows another embodiment of a laundry washing machine 700 having a mechanical UDP breaking mechanism. In this case, the mechanical UDP breaking mechanism is formed between the inner wall of the tub 104 and an outer wall of the drum 106. At least a portion of the space 702 between the inner wall of the tub 104 and the outer wall of the drum 106 comprises a narrow region that is sized to be smaller than the expected size of the UDP 704. As the drum 106 rotates, as shown by the arrow in FIG. 7, the UDP 704 is dragged into the narrow region of the space 702, where the UDP 704 is compressed and torn apart by contact with the tub 104 and drum 106. This narrow portion may be formed by the cylindrical walls of the tub 104 and drum 106, or it may be formed by (or include) one or more protrusions 706. The protrusions 706 may extend from the tub 104 towards the outer wall of the rotatable drum 106 and/or from the drum 106 towards the inner wall of the tub 104. The protrusions may comprise simple bumps, or they may have sharp edges or points that help break the UDP 704 apart. The particular size of the narrow region can vary depending on the expected size of UDPs being used with the machine, and if multiple different types of UDP are used the narrow region preferably is selected to be smaller than the smallest UDP size.

FIG. 7 also shows an example of an auxiliary loading port 708, which also may be used with other embodiments described herein. The auxiliary loading port 708 provides a separate access point for adding a UDP 704 to the laundry washing machine 700. In this example, the auxiliary loading port 708 comprises a sliding drawer that intersects the tub supply pipe 124 between the additive loading and supply system 114 and the tub 104. The drawer can be opened to receive a UDP 704, then closed to deposit the UDP 704 into the tub supply pipe 124. Other alternatives and variations will be apparent to persons of ordinary skill in the art in view of the present disclosure.

Figure 8:
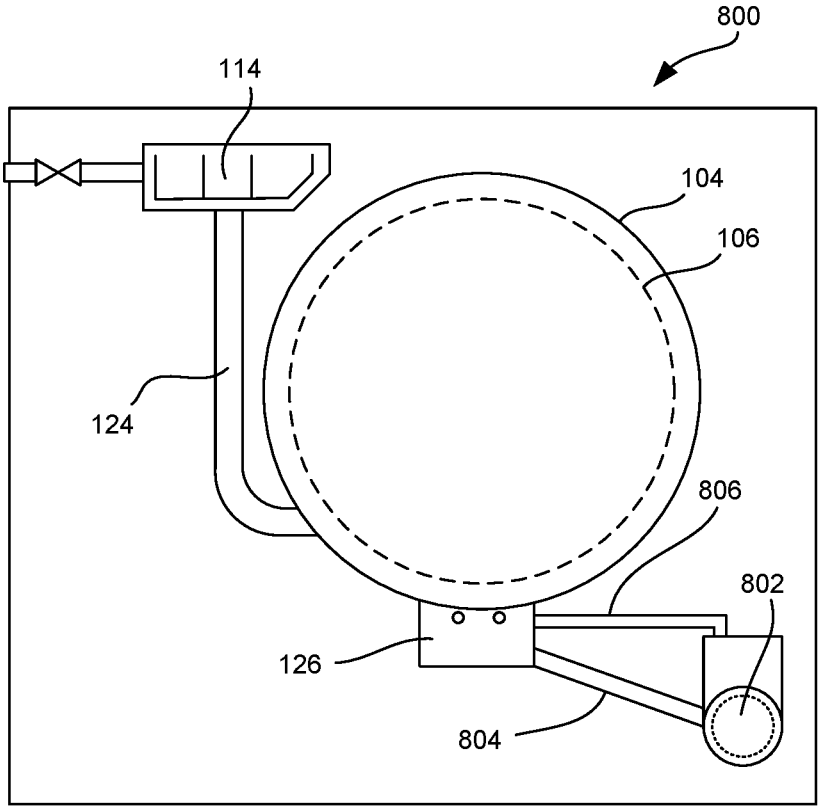
FIG. 8 is a schematic illustration of another embodiment of a laundry washing machine having a mechanical UDP breaking device.

FIG. 8 illustrates another embodiment of a laundry washing machine 800. In this example, the UDP is mechanically broken by a pump 802. The hydraulic line from the additive loading and supply system 114 to the pump 802 is sized to allow the UDP to flow all the way to the pump 802, and the pump 802 has an open impeller inlet that is sized to receive all or a portion of the UDP. As the UDP enters the impeller inlet, the impeller cuts or tears apart the UDP pouch. In the shown example, the pump 802 is a recirculation pump that receives the UDP through a pump inlet pipe 804 located downstream of a sump 126, such as the sump described above. A pump outlet pipe 806 leads back to the sump 126 to recirculate the water and the contents of the UDP. In other embodiments, the pump 802 may be fluidly located between the additive loading and supply system 114 and the tub 104, in which case the pump outlet pipe 806 may feed to the tub 104, the sump 126, or to other parts of the hydraulic line. In still other embodiments, the pump 802 may be downstream of the tub 104 or sump 126, but have an outlet pipe 806 that feeds to the tub 104 instead of leading back to the sump 126. Other alternatives and variations will be apparent to persons of ordinary skill in the art in view of the present disclosure.

Figure 9:
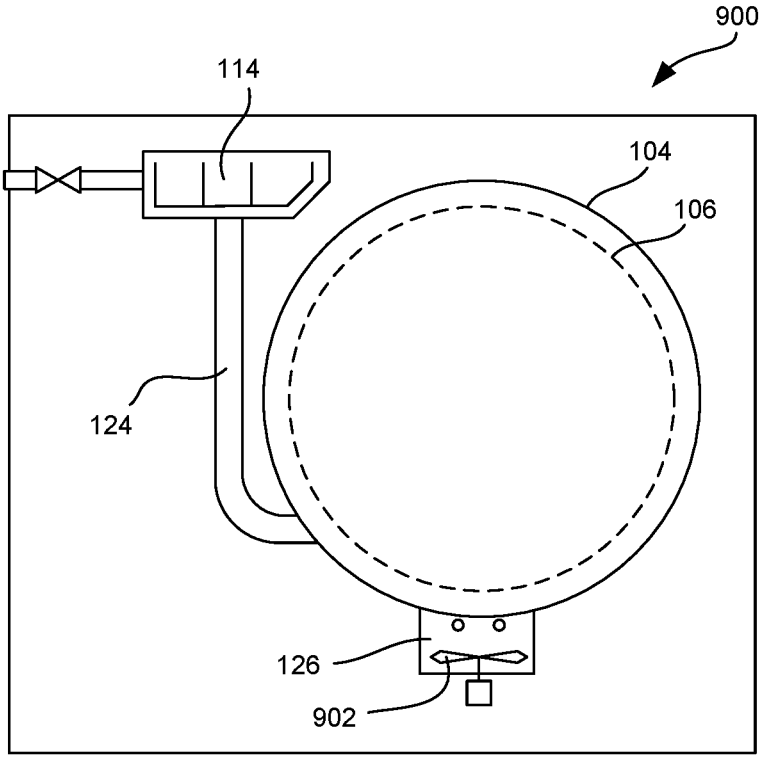
FIG. 9 is a schematic illustration of another embodiment of a laundry washing machine having a mechanical UDP breaking device.

FIG. 9 provides still another embodiment of a laundry washing machine 900. In this case, a mechanical breaking device is provided in the form of a mixer 902. The mixer 902 is configured to rotate or reciprocate in the sump 126 in order to contact and mechanically break apart the UDP. The mixer 902 map be configured with one or more sharp blades or pins, or one or more blunt rods or paddles, to cut or tear apart the UDP. For example, the mixer 902 may have one or more moving edges that spin or otherwise move within the sump 126. The mixer 902 also may comprise angled blades or paddles that cause fluid circulation within the sump 126, which may be helpful to pull the UDP into the mixer 902 and thoroughly mix the contents of the UDP with the water. The mixer 902 also may comprise one or more blunt arms that beat against the UDP to break it apart.

The mixer 902 may be operated by any suitable motor, such as an electric motor that is sealed from the liquid in the sump 126. The mixer 902 also may comprise a magnetic part (e.g., an iron bar) that is rotated by a corresponding magnetic part (e.g., a rotatable permanent magnet or electromagnet) located outside the sump 126. This arrangement provides simple fluid isolation because it does not require a driveshaft to pass through the sump wall. It is also envisioned that the mixer 902 may be located in other locations, such as in a reservoir located in the tub supply pipe 124 upstream of the tub 104. Other alternatives and variations will be apparent to persons of ordinary skill in the art in view of the present disclosure.

Figure 10:
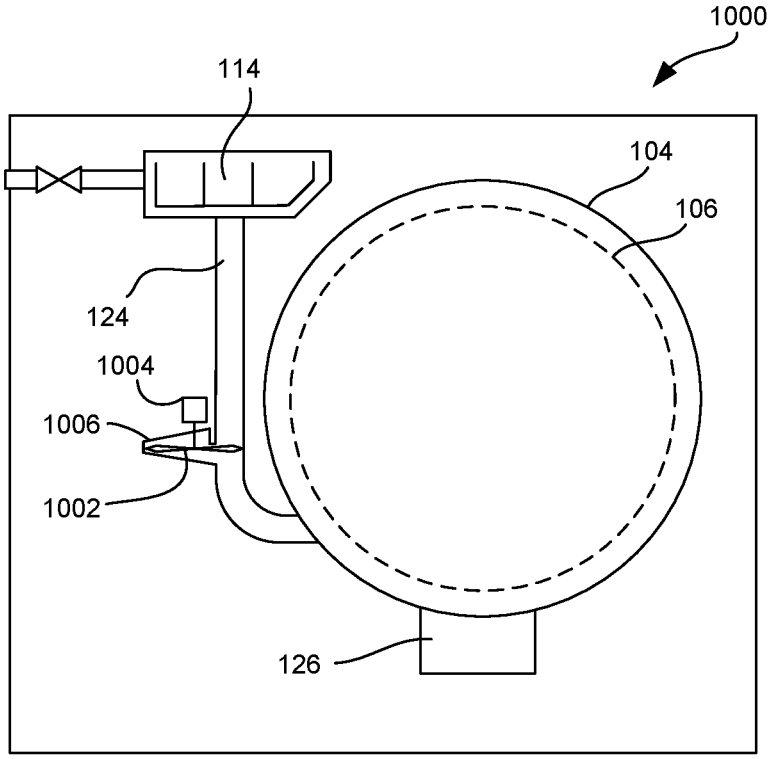
FIG. 10 is a schematic illustration of another embodiment of a laundry washing machine having a mechanical UDP breaking device.

Another embodiment of a laundry washing machine 1000 is shown in FIG. 10. In this case, the laundry washing machine has a mechanical breaking device in the form of a rotating cutter 1002 that intersects the tub supply pipe 124. The cutter 1002 is rotated (or reciprocated back and forth) by a motor 1004. The portion of the cutter 1002 that is not located within the tub supply pipe 124 at any given moment may be housed within a chamber 1006 that drains into the tub supply pipe 124. Thus, no water seal is required other than to seal the shaft of the drive motor 1004.

As with the embodiment of FIG. 5*c*, the cutter 1002 may comprise any suitable shape to tear the UDP open. For example, the cutter 1002 may comprise a disk having one or more openings with sharpened edges, such as found commonly in food processors, cheese graters, or the like. This arrangement provides a surface to hold the UDP while the cutter 1002 rotates. Alternatively, the cutter 1002 may comprise one or more blades or the like. Other alternatives and variations will be apparent to persons of ordinary skill in the art in view of the present disclosure.

While the foregoing embodiments generally describe the mechanical UDP breaking mechanism in the form of sharp objects (pins, blades, etc.), the breaking mechanism in these and other embodiments alternatively may be provided as one or more blunt objects, such as a rod or a series of rods or plates, that press on or grind the UDP to break it apart. For example, a mechanical UDP breaking mechanism may be provided in the form of pinch rollers or intermeshing gears located in the tub supply pipe 124. The pinch rollers or gears may be driven by one or more motors to compress and tear apart the UDP as it passes through the tub supply pipe 124. As another example, the sharp UDP breaking mechanisms described above may be replaced by a blunt structure that is capable of crushing the UDP sufficiently to tear open the pouch material. Other alternatives and variations will be apparent to persons of ordinary skill in the art in view of the present disclosure.

The foregoing embodiments are expected to provide several benefits. For example, using a mechanical UDP breaking mechanism can provide more reliable breaking of UDPs having different pouch compositions (i.e., different thickness, material, etc.). UDPs with different pouch compositions can require different times to dissolve, and some pouches may resist penetration by a water jet-type breaking device. A mechanical breaking device is likely to be able to handle such variations with less chance of not being able to open any particular UDP or any particular kind of UDP. Other benefits will be apparent to persons of ordinary skill in the art in view of the present disclosure and with use of the inventions described herein.

It will be appreciated that the laundry washing machines described in relation to FIGS. 5 through 10 may also include various other features, such as laundry washing machine features known in the art and features such as those discussed in relation to FIGS. 1 through 4.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this disclosure and the appended claims.

The invention claimed is:

1. A laundry washing machine comprising:

a casing;

a washing tub located within the casing;

a drum mounted within the washing tub and configured to rotate relative to the casing;

a door attached to the casing and being openable to provide access to the drum;

a drawer configured to receive a unit dose package comprising a water soluble pouch containing a dose of cleaning product, the drawer having an end insertable into a receptacle in the washing machine, and wherein a wall in the drawer is formed distally from the insertable end, said wall forming a boundary of a unit dose package holding volume between the insertable end and the wall, wherein the receptacle is configured to receive the drawer in a sliding motion, the receptacle including a top wall and a back wall, the receptacle including one or more blades extending from the top wall or the back wall, wherein the drawer includes one or more ribs extending from the drawer towards the one or more blades to press the unit dose package against the one or more blades when the drawer is slid into the receptacle such that the one or more blades mechanically break the unit dose package; and a tub supply pipe fluidly connecting the receptacle to the washing tub.

2. The laundry washing machine of claim 1, wherein the cutting edge extends from the top wall of the receptacle to adjacent the bottom wall of the receptacle.

3. The laundry washing machine of claim 1, wherein the drawer has a floor section, said floor section forming a bottom boundary of the holding volume, and wherein the blade extends from the top wall to adjacent the floor of the holding volume.

4. The laundry washing machine of claim 3, wherein the forcing edge of the one or more blades is a cutting edge.

5. The laundry washing machine of claim 4, wherein the rib comprises a cutting edge.

6. The laundry washing machine of claim 1, wherein the drawer has a floor section, said floor section forming a bottom boundary of the holding volume, and wherein the one or more blades comprises a forcing edge configured to force a unit dose package downward against said floor section.

7. The laundry washing machine of claim 1, wherein the drawer has a floor section, said floor section forming a bottom boundary of the holding volume, and wherein a rib extends upward from said floor section, said rib configured to force a unit dose package upward against the one or more receptacle blades.

8. The laundry washing machine of claim 1, wherein the one or more blades comprises a cutting edge, further wherein when the drawer is fully inserted into the receptacle, a cutting edge of the one or more blades is disposed adjacent the wall, wherein the wall is configured to prevent the one or more blades from forcing the unit dose package from the holding volume.

9. The laundry washing machine of claim 8, wherein one of the one or more blades extends from the top wall of the receptacle to adjacent the bottom wall of the receptacle.

10. The laundry washing machine of claim 8, wherein the drawer has a floor section, said floor section forming a bottom boundary of the holding volume, and wherein one of the one or more blades extends from the top wall to adjacent the floor of the holding volume.

11. The laundry washing machine of claim 1, wherein the drawer has a floor section, said floor section forming a bottom boundary of the holding volume, and wherein the one or more blades comprises a forcing edge configured to force a unit dose package downward against said floor section.

12. The laundry washing machine of claim 11, wherein the forcing edge of the one or more blades is a cutting edge.

13. A laundry washing machine comprising:

a casing;

a washing tub located within the casing;

a drum mounted within the washing tub and configured to rotate relative to the casing;

a door attached to the casing and being openable to provide access to the drum;

a drawer configured to receive a unit dose package comprising a water soluble pouch containing a dose of cleaning product, the drawer having an end insertable into a receptacle in the washing machine, and wherein a wall in the drawer is formed distally from the insertable end, said wall forming a boundary of a unit dose package holding volume between the insertable end and the wall;

a receptacle configured to receive the drawer in a sliding motion, the receptacle including a top wall and a back wall, the receptacle including a depending edge extending from the top wall or the back wall, wherein the drawer includes a rib extending from the drawer towards the depending edge to press the unit dose package against the depending edge when the drawer is slid into the receptacle such that the depending edge mechanically breaks the unit dose package; and tub supply pipe fluidly connecting the receptacle to the washing tub, wherein, when the drawer is fully inserted into the receptacle, the depending edge is disposed adjacent the wall.

14. A laundry washing machine according to claim 13, further comprising a plurality of ribs extending from the floor.

15. A laundry washing machine according to claim 14, wherein at least one of the plurality of ribs comprises a cutting edge.

16. A laundry washing machine according to claim 13, further comprising a plurality of depending edges extending from the top wall.

17. A laundry washing machine according to claim 16, wherein at least one of the plurality of depending edges comprises a cutting edge.

* * * * *